US008490213B2

(12) United States Patent
Neal

(10) Patent No.: US 8,490,213 B2
(45) Date of Patent: Jul. 23, 2013

(54) IMPACT AND SHARP IMPLEMENT RESISTANT PROTECTIVE ARMOR

(76) Inventor: Murray Lane Neal, Fresno, CA (US)

( * ) Notice: Subject to any disclaimer, the term of this patent is extended or adjusted under 35 U.S.C. 154(b) by 0 days.

(21) Appl. No.: 12/567,657

(22) Filed: Sep. 25, 2009

(65) Prior Publication Data

US 2010/0080971 A1 Apr. 1, 2010

Related U.S. Application Data

(60) Provisional application No. 61/100,629, filed on Sep. 26, 2008.

(51) Int. Cl.
*F41H 5/04* (2006.01)
*F41H 1/02* (2006.01)
*F41H 5/00* (2006.01)

(52) U.S. Cl.
USPC ..... 2/2.5; 428/911; 89/36.02

(58) Field of Classification Search
USPC ..... 2/455, 456, 2.5
See application file for complete search history.

(56) References Cited

U.S. PATENT DOCUMENTS 4,309,487 A * 1/1982 Holmes ..... 428/516
4,413,357 A * 11/1983 Sacks ..... 2/2.5
5,854,143 A * 12/1998 Schuster et al. ..... 442/135
5,996,115 A * 12/1999 Mazelsky ..... 2/2.5
6,035,438 A * 3/2000 Neal et al. ..... 2/2.5
6,170,378 B1 * 1/2001 Neal et al. ..... 89/36.05
6,253,655 B1 * 7/2001 Lyons et al. ..... 89/36.02
6,370,690 B1 * 4/2002 Neal ..... 2/2.5
6,510,777 B2 * 1/2003 Neal ..... 89/36.05
6,647,856 B1 * 11/2003 Neal ..... 89/36.02
6,703,104 B1 * 3/2004 Neal ..... 428/118
6,705,197 B1 * 3/2004 Neal ..... 89/36.05
6,745,661 B1 * 6/2004 Neal et al. ..... 89/36.02
2001/0015157 A1 * 8/2001 Neal ..... 109/49.5
2005/0037189 A1 * 2/2005 Palmer et al. ..... 428/304.4
2006/0075544 A1 * 4/2006 Kriesel et al. ..... 2/411
2007/0172677 A1 * 7/2007 Biermann et al. ..... 428/469
2010/0031810 A1 * 2/2010 Neal ..... 89/36.02

FOREIGN PATENT DOCUMENTS

GB 915345 1/1963

OTHER PUBLICATIONS

Neal, Murray L., PCT Search Report and Written Opinion mailed Dec. 22, 2009, PCT/US2009/058665 filed Sep. 28, 2009, 15 pages.

* cited by examiner

*Primary Examiner* — Bobby Muromoto, Jr.
(74) *Attorney, Agent, or Firm* — Blakely Sokoloff Taylor & Zafman, LLP

(57) ABSTRACT

A method and apparatus for providing impact, abrasion and sharp implement resistance to a body. The apparatus including an impact layer having a plurality of plates adhered to a layer of penetration resistant fabric and an energy absorptive layer including an energy absorptive material coupled to the impact layer. The apparatus may further include a layer of woven fabric and a layer of multiple plies of a penetration resistant fabric.

23 Claims, 6 Drawing Sheets

IMPACT AND SHARP IMPLEMENT RESISTANT PROTECTIVE ARMOR

CROSS REFERENCE TO RELATED APPLICATIONS

This application claims priority from U.S. Provisional Patent Application Ser. No. 61/100,629, filed on Sep. 26, 2008, which is incorporated herein by reference in its entirety.

FIELD

Protective wear. More specifically, a flexible body covering designed to resist high impact energy, abrasion and sharp implement penetration.

BACKGROUND

In recent years garments with thick foams, rubber and plastic reinforcements, have gone into common use in the field of sports for high energy impact protection. Such sports include: Football, Hockey, Mountain climbing, Rodeo and Bull fighting, La Crosse, Water skiing, Soccer, BMX and other racing sports, Motorcycle riding, Martial Arts, Rugby, Snow boarding, Skate boarding, Paint Ball and other X-Game style sports. Unfortunately, soft body armor, even with these advanced materials, has proven insufficient to appropriately thwart the high energy impacts from, for example, contact impacts and accidents that regularly occur during these sports, sharp thrusting instruments and circular penetrators such as the spikes in winter sports tires, pointed implements like the handle bars of a motorcycle or the horn of a bull. Additionally, armor systems and garments designed to resist penetration, for example, garments for corrections and/or law enforcement personnel and safety garments for various industrial safety applications, provide inadequate protection against sharp objects, cutting tools and circular penetrators.

To address these problems, various garment style materials such as leather and other aramid and polyethylene type materials have been developed. For example, materials used in a jerseys, jackets, vests or other garments designed to shield soft targets or areas of the body from high energy impacts for sports such as football, hockey and bull riding include thick foams and plastics. Such garments, however, are thick and difficult to move around in thereby impeding performance. Coupling rigid plastic plates with these thick foams or plastics has further not alleviated such problems because the materials are thick resulting in a stiff garment which is less flexible and restricts movement of the wearer.

The same problems are encountered in the context of garments for protection against sharp pointed objects and circular penetrators in the correctional/law enforcement setting and/or industrial applications encountering among other things glass, metals, wood knives, saws and other implements and tools that cut or pierce through a whole array of textiles and plastic materials.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1A:
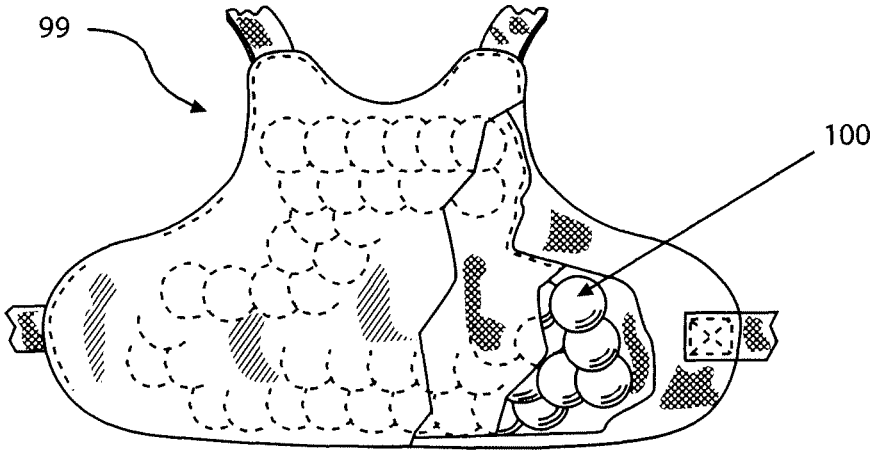
FIG. 1A is a cut away view of one embodiment of the drawing of the protective body covering.

FIG. 1A is a cut away view of one embodiment of the drawing of the protective body covering. In one embodiment, the protective body covering may be in the form of piece 99 designed to preclude injury due to the high energy impacts, cuts, abrasions and piercings such as those previously discussed. Protection piece 99 contains or acts as a carrier for structures 200, 300, 400 and 500 depicted in FIGS. 2-5. Piece 99, in this example, is a jacket or vest that covers the vital organ area of the torso. Although piece 99 is in the shape of a vest in FIG. 1A, piece 99 may have any size and shape suitable for wearing over a desired area of protection. For example, where piece 99 is to be worn over a body limb or joint, piece 99 may have a rectangular shape.

Piece 99 provides flexibility as a result of the thinness of the material layers and overlapping configuration of the material layers. In addition, the materials used in construction of piece 99, as will be discussed in more detail below, may be light weight so that an overall weight of piece 99 remains low. For example, piece 99 in the form of a vest may have a weight of from about one and three-quarters to two and a half pounds. Other carriers for structures 200, 300, 400 and 500 illustrated in FIGS. 2-5 include chaps for the legs, gauntlet for the arms, guards for the shins and thighs as well as others. Applications of structures 200, 300, 400 and 500 include use in body protection garments for use in sports (e.g., American football, soccer, bull riding and motorcycle and snowmobile racing), industrial applications (e.g., to protection against blades and edges of power tools such as saws), and correctional facility personnel (e.g., to protect against cutting by a knife and penetration by a spike).

Piece 99 includes a layer of plates 100 laid out in an imbricated pattern to cover vital areas underlying piece 99. In one embodiment, plates 100 may be in the shape of disks as illustrated in FIG. 1A. The imbricated pattern is formed where, starting at the interior of a row, a disk 100 overlaps its predecessor in the row and is overlapped by its successor in the row, as shown. Subsequent rows overlap the predecessor and are overlapped by their successor. In this aspect, disks 100 in a single layer overlap. Unlike the thick rigid plastic plates and/or foams previously discussed, the imbricated pattern conforms around body contours in a thin configuration and therefore is considerably more comfortable, readily concealable and does not impede movement of the body. In addition, the overlap of the imbricated placement pattern of disks 100 effectively spreads the force of the high impact energy hit to adjacent disks, thereby preventing penetration and substantially reducing backside deformation of piece 99. Still further, because of the slight tilt of each overlapping disk in the imbricated pattern, a perpendicular hit is less likely and some of the energy of a surface strike will be absorbed into deflection of other adjacent disks.

Disks 100 are formed of a light weight high hardness material as will be discussed in more detail below. Disks 100 may have a diameter of from about one inch to about two inches, for example about one and a half inches. In some embodiments, disks 100 may have a uniform thickness in the range of from about 0.020 to about 0.125 inches, for example, from 0.032 to 0.070 inches or from 0.032 to 0.060 inches. Although a representative thickness range is disclosed, it is contemplated that the thickness of disks 100 may vary depending upon the density, hardness and fracture resistance of the material of disks 100.

Figure 1B:
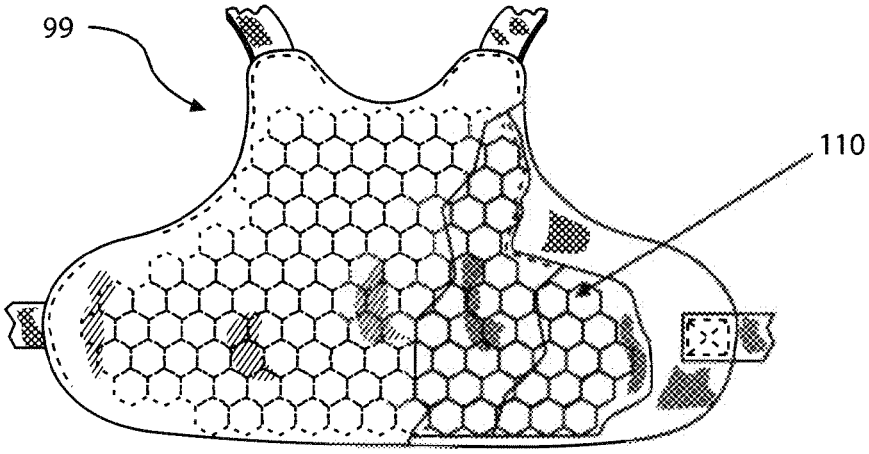
FIG. 1B is a cut away view of another embodiment of the drawing of the protective body covering.

FIG. 1B illustrates another embodiment of piece 99 employing a number of plates 110 having a hexagonal shape. Plates 110 are arranged in a single layer with each edge of a plate touching an edge of another plate, but not overlapping. Plates 110 allow piece 99 to flex at their intersection and to conform around body contours making piece 99 comfortable and readily concealable. Plates 110 may have a width of from about one inch to about two inches, for example about one and a half inches. In some embodiments, plates 110 may have a uniform thickness in the range of from about 0.020 to about 0.125 inches, for example, from 0.032 to 0.070 inches or from 0.032 to 0.060 inches. Although a representative thickness range is disclosed, it is contemplated that the thickness of plates 110 may vary depending upon the density, hardness and fracture resistance of the material of plates 110.

Although disks and hexagonal shaped plates having a uniform thickness are illustrated in FIG. 1A and FIG. 1B, it is further contemplated that disks and/or plates having other dimensions may be used in piece 99. For example, plates having a triangular shape (e.g. isosceles triangle) may be used and arranged in an alternating tip to base configuration. Still further plates or disks having a non-uniform thickness such as discus shaped disks may be used.

Disks 100 and plates 110 may be made of a high hardness, light weight material. Various types of high hardness, light weight materials can be used. In some embodiments, suitable materials may include non metallic materials such as, but not limited to, polycarbonate, thermoplastic, thermoset, elastomer, acrylic, Delrin®, acrylonitrile-butadiene-styrene (ABS), nylon, polystyrene, high pressure composites, polyamide, polyetheretherketone (PEEK), ethylene propylene dimonomer (EPDM), polyethylene terephthalate (PET), polytetrafluoroethylene (PTFE), polymonochlorotrifluoroethylene (PCTFE), ultra high molecular weight (UHMW) materials, polyimide, polyurethane, glass, a carbon and mineral filled compound, elastomer coated fabric, polyethylene, or thin, lightweight ceramic materials. Suitable materials may further include light weight metal materials such as, but not limited to, aluminum, magnesium, and titanium. Although representative materials for disks 100 are disclosed herein, it is contemplated that other light weight materials having a high hardness may be used. It is further contemplated that suitable materials will be flame and chemical resistant and have a resistance to high heat and extreme cold. In addition, suitable materials for disks 100 are preferably non-hydroscopic (i.e., the material doesn't absorb water). Plates 110 may be made of the same materials described above in reference to disks 100.

As will be discussed in more detail in reference to FIGS. 2-5, the disk layout is then attached to a substrate such as an aramid fabric or other cut resistant textile (e.g., layer 103 in FIG. 2). A second layer of aramid fabric (e.g., layer 104 in FIG. 2) may be used to envelop the layer formed by disks 100. This enveloped panel forms an impact layer which can be attached to impact gels or other impact energy absorbing and dissipating materials. For added protection from penetration, the enveloped panel may further be attached to a soft body armor textile. The resulting structure may then be incorporated into the carrier illustrated by piece 99.

Piece 99 provides flexibility which does not impede movement of the wearer through its thinness and overlapping material layer configuration. Representatively, an overall thickness of piece 99 (including structure 200, 300, 400 or 500 therein) may be from about 5/16 inch to about 5/8 inch. For example, in embodiments where piece 99 is designed for sports applications, piece 99 may have an overall thickness of from about 5/16 inch to about 9/16 inch. In embodiments, where piece 99 is designed for industrial applications, piece 99 may have an overall thickness of from about 3/8 inch to about 5/8 inch. In addition, the imbricated disk pattern and material layers of piece 99 provide for overall energy dispersion over a larger surface area. In particular, rather than just one very pointed and/or narrow impact location with a deepened impact zone, piece 99 dissipates the energy to a larger area being not as deep as the impact zone. As a result, the rearward or back face signature of the impact region into the body is reduced. This further helps to reduce bruising, and damage to organs, bones and tissue.

Figure 2:
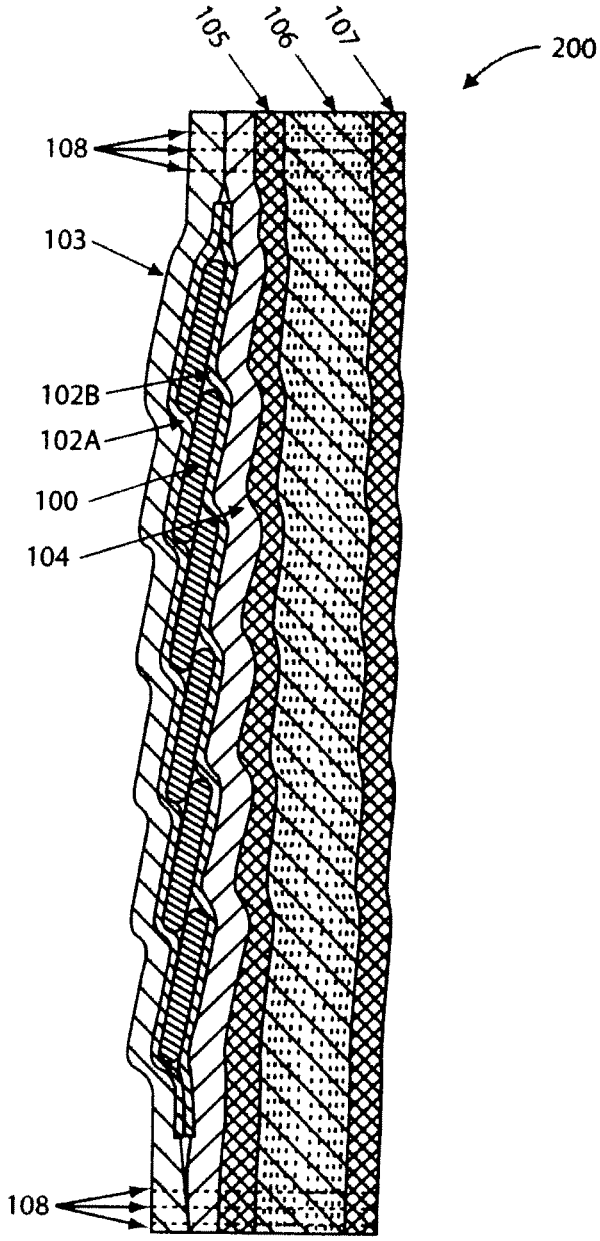
FIG. 2 is a side cut away cross sectional view of one embodiment of the protective body covering.

FIG. 2 illustrates another embodiment of a side cut away cross sectional view of one embodiment of a material structure of the body protection piece. Structure 200 may be incorporated into a carrier such as piece 99 as previously discussed in reference to FIG. 1B. In this embodiment, from strike face toward the wearer side, structure 200 includes first layer 103 constructed of a high tensile strength fiber material. The high tensile strength fiber material may be a material that is cut resistant. Representatively, first layer 103 may be made of an aramid textile material. Aramid textile materials are 10 times stronger than steel by weight, are cut resistant, are not flammable and handle high heat and low cold exposure. In some embodiments, the aramid textile material may be a Twaron® 930 DTEX textile with a plain weave. Twaron® 930 DTEX weighs approximately 6 ounces per square yard and is 14 mils in nominal thickness. Twaron® is commercially available from Akzo Nobel Twaron, Inc. of Arnhem of the Netherlands. The weave count of Twaron® 930 DTEX provides sufficient flexibility to piece 99 due to the low pick count while still maintaining the 900 and 950 breaking strength in the warp and fill directions.

In other embodiments, the aramid textile material of first layer 103 may be made of Kevlar® Correctional. Kevlar® Correctional is available from E.I. du Pont de Nemours and Company of Wilmington, Del. Kevlar® 159, for example, is a 200 denier textile with a plain weave consisting of a 70×70 warp and fill pick count, and an areal density of 3.9 ounces per square yard. It has a thickness of 7 mils and a breaking strength of 385 and 530 respectively relating to the warp and fill layup.

Another suitable aramid textile material for first layer 103 may be Turtleskin®. Turtleskin® is a woven aramid textile woven by Warwick Mills of P.O. box 409, 301 Turnpike Road, New Ipswich, N.H. 03071, and sold under variants called TurtleSkin® Sport™, TurtleSkin® Flex™ TurtleSkin® Diamond Coat™, and TurtleSkin® Palm Master™. These are all a Kevlar® 29 products manufactured by Dupont®. Each of these materials have a 110×68 warp and fill pick count, or as referred to by Warwick mills (pick & sley). The TurtleSkin® Sport™ has an areal density of 7.2 ounces per square yard. A thickness of 0.015 mm and a tensile of 212 and 566 respectively relating to the warp and fill layup. The TurtleSkin® Flex™ has an areal density of 6.9 ounces per square yard. A thickness of 0.012 mm and a tensile of 239 and 918 respectively relating to the warp and fill layup. The TurtleSkin® Diamond Coat™ has an areal density of 13 ounces per square yard. A thickness of 0.019 mm; and unpublished tensile data.

The TurtleSkin® Palm Master™ has an areal density of 9.9 ounces per square yard. A thickness of 0.017 mm; and unpublished tensile data.

It is further contemplated that first layer 103 may be made of a lower denier count aramid fabric than those previously disclosed which is impregnated with a shear thickening fluid or silicone dilatants. As a result of the impregnation, the lower denier fabric may have greater deformation power than a non-impregnated high denier fabric. It is further contemplated that due to the greater deformation resistance of the impregnated aramid fabric, fewer plies of material in structure 200 may be needed to achieve the desired protective results.

Underlying first layer 103 is second layer 102A, which in combination with fourth layer 102B envelopes a third layer formed by disks 100. Second layer 102A and fourth layer 102B are made of an adhesive material used to adhere disks 100 in the imbricated pattern to first layer 103. In one embodiment, the adhesive material of second layer 102A and fourth layer 102B is a highly aggressive adhesive such as a petroleum or acrylic based low modulus adhesives commercially available from Bondtex Inc., Los Angeles, Calif. Third layer 100 is the imbricated disk layout configuration as depicted in FIG. 1A. Alternatively, layer 100 may be the tile configuration described in reference to FIG. 1B.

Fifth layer 104 is positioned along a side of fourth layer 1028 opposite the layer of disks 100. The addition of fifth layer 104 can provide structure 200 with added protection from penetration for pointed objects and cutting. In this aspect, fifth layer 104 may be constructed of a high tensile strength fiber material which is cut resistant. Representatively, fifth layer 104 may be an aramaid textile material such as those described in reference to first layer 103. In this aspect, the imbricated layer of disks 100 is sandwiched between first layer 103 of aramid fabric and layer 104 of aramid fabric by the adhesive second layer 102*a* and fourth layer 102*b*.

Sixth layer 105 is positioned along a side of fifth layer 104 opposite fourth layer 102B. Sixth layer 105 may be made of a woven textile material. Representative woven textile materials for sixth layer 105 may include, but are not limited to, a 210 or 400 denier nylon, poly/cotton or Cordura textile in a 500, 750 or 1000 denier plain weave configuration.

Seventh layer 106 is positioned along a side of sixth layer 105 opposite fifth layer 104. Seventh layer 106 may be made of an energy absorbing material. A thickness of the energy absorbing material used for seventh layer 106 may vary. For example, in embodiments where structure 200 is incorporated into a vest to be worn across a chest, it may be desirable to have more protection along the collar bone than the lower chest regions, such as the bottom of the ribs. In this aspect, a thickness of the energy absorbing material within the portion of seventh layer 106 overlying the collar bone may be greater than the thickness of the portion of seventh layer 106 near the bottom of the ribs. For example, the material along the collar bone may be about ⅜ inch to about ½ inch thick while the thickness near the bottom of the ribs may be about ⅛ inch to about ¼ inch. Although representative thicknesses for different portions of seventh layer 106 are disclosed, it is contemplated that the thickness may vary depending upon the desired protection level.

The energy absorbing material of seventh layer 106 may be light weight and resiliently compressible. Various types of light weight resiliently compressible energy absorbing materials can be utilized. Representative materials include, but are not limited to, elastomer foams, latex rubbers, synthetic polymers, polyurethane foams, ethyl vinyl acetate (EVA) foams, (polyethylene) PE foams, neoprene, thermoplastic elastomers and thermoplastic polyesters, EP rubber, silicone rubbers, EPDM rubbers, and closed cell foams. Suitable materials for seventh layer 106 may have a Shore 00 hardness from approximately 12 to 50, utilizing the ASTM D2240 test method. Suitable materials for seventh layer 106 may further have an overall density per cubic foot of approximately 25 to 65, utilizing the ASTM D792-00 test method, and a resilience percentage of approximately 10 to 13, utilizing the ASTM D2632 test method. Such materials can be used independently or in a dual-density configuration.

Another exemplary type of energy absorbing light weight material is a material composed of a shear thickening silicone dilatant, fluid or putty added to a textile component or manufactured into a self supporting elastomeric matrix with or without particulate reinforcement additives such as fibrous fillers, plasticisers, extenders, lubricants, and whisker or tubular fillers. Such materials will exhibit a resistive load under deformation or high or elevated strain rates which will increase with the rate of deformation due to the impact. These types of shear thickening materials actually have viscously low flow rates of strain deformation until an elevated strain rate increases the viscosity where they become substantially stiff or rigid to and inelastic under to attenuate the energy. Such materials are typically in two forms, namely, either a putty like dilatant in an unsuspended or non self-supporting nature or a solid closed cell foam matrix. Putty like dilatants are contained within an envelope due to their non-supporting nature. This is usually in the form of a plastic or polymer containment bag, designed with multiple seamed cells or "baglets" to preclude flowing into one region of a continuous single sectioned bag. The solid closed cell foam matrix is resiliently compressible.

Any composite materials utilized as the energy absorbent material of seventh layer 106 should be resistant to a permanent set condition under various types of loading such as compression, tension, shear or a combination of any of these. In addition, suitable energy absorbing light weight materials should have a quick recovery time from compression, e.g., within a few seconds.

The configurations of the above light weight resiliently compressible energy absorbing and attenuating materials can be in a full unit of material such as a fully dimensioned (for the specific area to be protected) pad. Alternatively, the material can be laid out into hexagonal or round side-by-side points or "rounds/nodes." Still further, the material can be in the form of multiple seamed cells or "baglets" depending upon the material that is not directly connected such as in a honeycomb configuration or grid. Cells can take the shape of hexagonal, round, square, triangular or other dimensioned shapes as necessary to provide for protection while still maintaining the flexibility of piece 99.

Eighth layer 107 is positioned along a side of seventh layer 106 opposite sixth layer 105. Similar to sixth layer 105, eighth layer 107 may be made of a woven textile material. Representative woven textile materials may include, but are not limited to, a 210 or 400 denier nylon, poly/cotton or Cordura textile in a 500, 750 or 1000 denier plain weave configuration. Sixth layer 105 and eighth layer 107 allow for the energy absorbing material of seventh layer 106 to be sewn into the entire configuration as shown in FIG. 2. Layers 103, 104, 105, 106 and 107 may be sewn together using, for example, Kevlar® aramid stitching 108.

Figure 3:
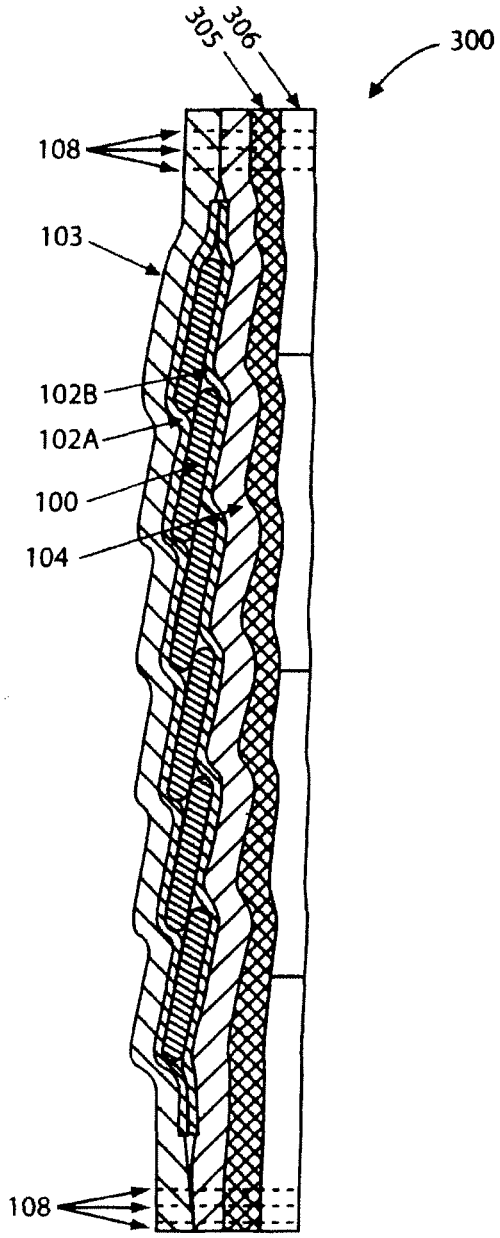
FIG. 3 is a side cut away cross sectional view of one embodiment of the protective body covering.

FIG. 3 illustrates another embodiment of a side cut away cross sectional view of one embodiment of a material structure of the body protection piece. Structure 300 may be incorporated into a carrier such as piece 99 as previously discussed in reference to FIG. 1B. Structure 300 includes layers 100, 102A, 102B, 103 and 104 which are substantially similar to those previously disclosed in reference to FIG. 2. Similarly, stitching 108 is Kevlar® aramid stitching as disclosed in reference to FIG. 2.

Structure 300 includes sixth layer 305 positioned along a side of fifth layer 104 opposite fourth layer 102B. Sixth layer 305 may be an adhesive layer designed to adhere fifth layer 104 and seventh layer 306 together. The adhesive material of sixth layer 305 may be a highly aggressive adhesive such as a petroleum or acrylic based low modulus adhesives commercially available from Bondtex Inc., Los Angeles, Calif.

Seventh layer 306 may be a light weight resiliently compressible energy absorbing material such as those previously discussed in reference to FIG. 2. In this embodiment, the energy absorbing material may be placed within cells or "bladders" of plastic, polyethylene, or urethane coated textile components. Such a configuration provides uniformity in thickness and width thereby allowing for increased or decreased energy absorbing capabilities throughout a single light weight resiliently compressible energy absorbing pad, garment or area of protection. The materials used for the encapsulation of the light weight resiliently compressible energy absorbing material is sealed such as with an ultrasonic sealer to preclude leakage of the material from one cell and into another cell location.

Figure 4:
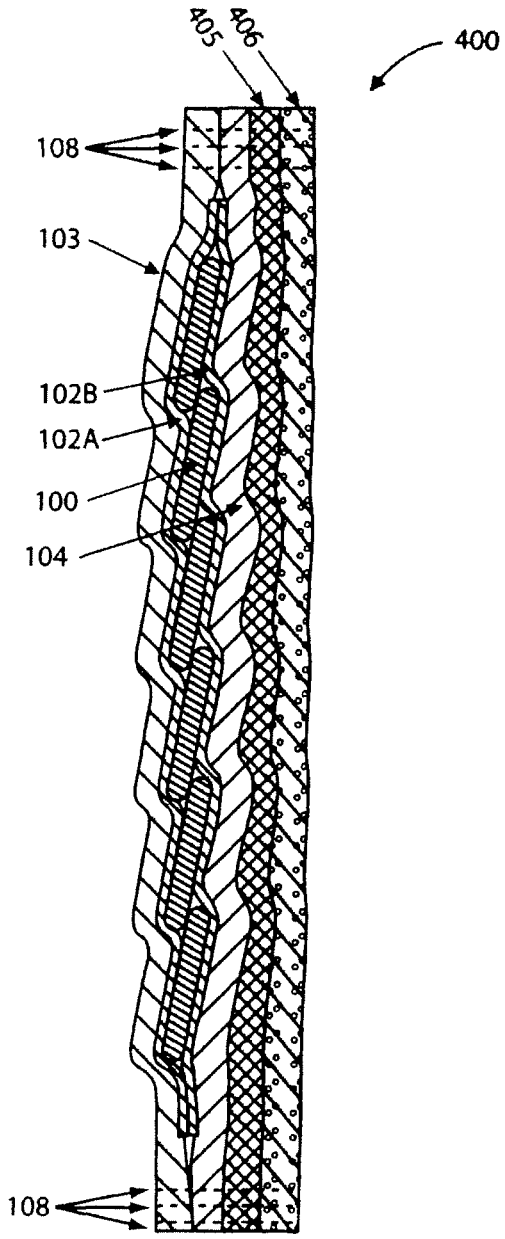
FIG. 4 is a side cut away cross sectional view of one embodiment of the protective body covering.

FIG. 4 illustrates another embodiment of a side cut away cross sectional view of one embodiment of a material structure of the body protection piece. Structure 400 may be incorporated into a carrier such as piece 99 as previously discussed in reference to FIG. 1B. Structure 400 includes layers 100, 102A, 102B, 103 and 104 which are substantially similar to those previously disclosed in reference to FIG. 2. Similarly, stitching 108 is Kevlar® aramid stitching as disclosed in reference to FIG. 2.

Structure 400 includes sixth layer 405 positioned along a side of fifth layer 104 opposite fourth layer 102B. In this embodiment, sixth layer 405 may include multiple plies of fabric. Representatively, sixth layer 405 may be an aramid constructed layer comprised of multiple plies of aramid material. The plies of aramid material may be quilted with one inch diamond quilting and with a perimeter stitch surrounding the aramid textile component.

Seventh layer 406 may be positioned along a side of sixth layer 405 opposite fifth layer 104. Similar to sixth layer 405, seventh layer 406 may include multiple plies of fabric. Representatively, sixth layer 405 may be an aramid constructed layer comprised of multiple plies of aramid material that is quilted with one inch diamond quilting and with a perimeter stitch surrounding the aramid textile component. Sixth layer 405 and seventh layer 406 may be made of the same or different materials.

In some embodiments, sixth layer 405 may have fifteen plies of Kevlar® Correctional aramid textile and seventh layer 406 may have seven plies of Kevlar® Correctional aramid textile. Kevlar® Correctional aramid textile is a Kevlar® 159, 200 denier textile with a plain weave consisting of a 70×70 warp and fill pick count. Although layers including seven and fifteen plies of the material are disclosed, the exact amount of plies in each of layers 405 and 406 can be adjusted to match the penetration resistance requirement of the cutting or penetrating implement. In this aspect, sixth layer 405 and seventh layer 406 may have the same number or a different number of plies. Sixth layer 405 and seventh layer 406 are independently quilted and perimeter stitched. Sixth layer 405 and seventh layer 406 are held into place with the remaining layers 100, 102A, 102B, 103 and 104 by a perimeter stitch around the perimeter area of each layer (e.g., stitching 108).

Figure 5:
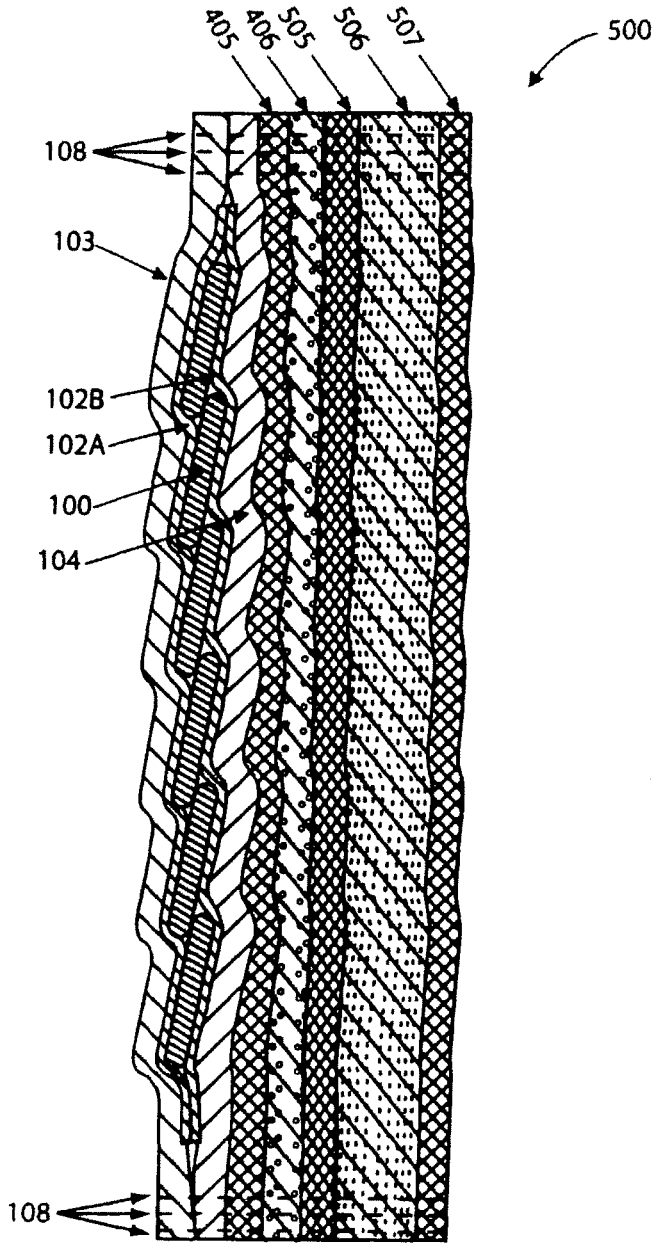
FIG. 5 is a side cut away cross sectional view of one embodiment of the protective body covering.

FIG. 5 illustrates another embodiment of a side cut away cross sectional view of one embodiment of a material structure of the body protection piece. Structure 500 may be incorporated into a carrier such as piece 99 as previously discussed in reference to FIG. 1B. Structure 500 includes layers 100, 102A, 102B, 103 and 104 which are substantially similar to those previously disclosed in reference to FIG. 2 and layers 405 and 406 which are substantially similar to those disclosed in reference to FIG. 4. Similarly, stitching 108 is Kevlar® aramid stitching as disclosed in reference to FIG. 2.

Structure 500 includes eighth layer 505 positioned along a side of seventh layer 406 opposite sixth layer 405. Eighth layer 505 may be made of a woven textile material such as a 210 or 400 denier nylon, poly/cotton or Cordura textile in a 500, 750 or 1000 denier plain weave configuration.

Ninth layer 506 is positioned along a side of eighth layer 505 opposite seventh layer 406. Ninth layer 506 may be made of a light weight resiliently compressible energy absorbing materials such as those previously described.

Tenth layer 507 is positioned along a side of ninth layer 506 opposite eighth layer 505. Similar to eighth layer 505, tenth layer 507 may be made of a woven textile material such as a 210 or 400 denier nylon, poly/cotton or Cordura textile in a 500, 750 or 1000 denier plain weave configuration.

Eighth layer 505 and tenth layer 507 are attached to ninth layer 506. Eighth layer 505 and tenth layer 507 allow for energy absorbing materials to be sewn into the configuration as shown in FIG. 5 by stitching 108 (e.g. Kevlar® aramid stitching).

The structures of FIG. 2 and FIG. 3 may be suitable for sports or other applications that require a light weight protection piece, while the structures in FIG. 4 and FIG. 5 may be more suited for industrial and correctional uses that subject the wearer to cutting and penetration risks.

Returning to piece 99 referenced with respect to FIG. 1A and FIG. 1B, although exemplary materials and layer configurations for structures 200, 300, 400 and 500 incorporated into piece 99 are disclosed herein, it is contemplated that other suitable materials and layer configurations may be used depending upon the desired protection characteristics of piece 99. In particular, the tensile strength of a woven aramid textile fabric is a leading indicator of the fabric's ability to grab onto and defeat penetration by a sharp implement. In particular, a higher tensile strength gives the fabric a better ability to grab the sharp implement before yield than a lower tensile strength fabric. The fabric's grabbing of the sharp implement before yielding is what forces a "fiber crimp" around the implement and prevents it from penetrating. A "fiber crimp" is created when woven aramid materials (e.g. Twaron® 930 DTEX) are plied together and then quilted to preclude them from moving and shifting or sliding past each other. This configuration also eliminates "bunching-up" at a bottom layer which occurs when materials are too pliable and further keeps the material sufficiently stiff to keep the sharp implement in a vertical position parallel to the body. The cross-over points of the weaves of the materials never align and therefore you have loose intersections between the cross-over locations. The crossover locations provide for increased resistance to penetration, and if some slight penetration occurs, then the offsets of each layer add to the overall resistance to the shank or shaft of, for example the sharp implement, as it attempts to go though the material by making it tighter to get through. The tensile strength of a thread of aramid textile material can be increased by increasing the denier of the thread. Thus a 900 denier material will have a higher tensile strength than a 200 denier material of an identical fiber.

The behavior of high tensile strength aramid penetration resistant materials is the result of the materials tensile strength, elongation to failure, weave style and pick count. When struck by a penetrating implement, a high tensile strength aramid material with a high pick count and a high elongation to failure will tend to grab at the implement and turn it to induce bending or preclude penetration all together.

Based on the foregoing, it is contemplated that where piece 99 is to be worn during a sporting event which does not utilize sharp implements (e.g. Snow Boarding), the structure within piece 99, for example structure 200 in FIG. 2, requires fewer woven aramid material layers (e.g. Twaron® 930 DTEX) to achieve the desired level of protection.

It is further noted that similar aramid textile materials with differing pick count and deniers are different fabrics which provide different results when subjected to forces from a sharp implement. In addition, materials with similar deniers and similar pick counts do not necessarily have identical defeating capabilities. In particular, a varying elongation to failure could make these materials completely dissimilar. Accordingly, knowledge of a pick count and/or denier of a material, without more, would not lead to the construction of a protective covering having the defeating capabilities disclosed herein.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

The invention claimed is:

1. A protective covering comprising:

an impact layer comprising a plurality of polymer plates adhered to and sandwiched between a first and a second layer of penetration resistant fabric; and an energy absorptive layer comprising a resiliently compressible energy absorptive material coupled to the impact layer, resiliently compressible material having a resilience percentage of approximately 10 to 13, utilizing an ASTM D2632 test method and an overall density per cubic foot of approximately 25 to 65, utilizing the ASTM 0792-00 test method, the energy absorptive layer distinct from and coupled to the impact layer, wherein the energy absorptive layer has a thickness in the range of approximately ⅛ inch to ½ inch.

2. The protective covering of claim 1, wherein the layer of penetration resistant fabric is an outer layer and the plurality of plates are adhered on one side to the outer layer of penetration resistant fabric and on an opposite side to an inner layer of penetration resistant fabric.

3. The protective covering of claim 1, wherein the plurality of plates are in the shape of disks, the disks arranged in an imbricated pattern such that adjacent disks in a single layer overlap.

4. The protective covering of claim 1, wherein the plurality of plates have a hexagonal shape.

5. The protective covering of claim 1, wherein the energy absorptive layer comprises a material including a foam, a rubber, a polymer or a thermoplastic.

6. The protective covering of claim 1, wherein the energy absorptive layer comprises a composite material including a thickening component and a textile component.

7. The protective covering of claim 1, wherein a thickness of a first portion of the energy absorptive layer is different from a thickness of a second portion of the energy absorptive layer.

8. The protective covering of claim 1 further comprising:

a layer of woven fabric coupled to the energy absorptive layer.

9. The protective covering of claim 1 further comprising:

at least one layer comprising a plurality of plies of material coupled together with field quilting and a perimeter stitch.

10. The protective covering of claim 1, wherein the covering is coupled to a carrier dimensioned to be worn over an area of the body to be protected.

11. A method of making a protective covering comprising:

coupling a plurality of plates to a first layer of penetration resistant fabric and a second layer of penetration resistant fabric;

coupling the second layer of penetration resistant fabric to a third layer; and coupling the third layer to a fourth layer comprising a resiliently compressible energy absorptive material, wherein the energy absorptive layer including shear thickening silicone dilatant, the shear thickening silicone dilatant is disposed within the energy absorptive layer as one of a fluid within a plurality of baglets or instantiated as a self supporting matrix.

12. The method of claim 11, wherein the plurality of plates are disks arranged in an imbricated pattern.

13. The method of claim 11, wherein the third layer comprises a woven fabric.

14. The method of claim 11, wherein the third layer comprises a penetration resistant fabric.

15. The method of claim 11, wherein the third layer comprises an adhesive material.

16. The method of claim 11, wherein the third layer comprises multiple plies of a penetration resistant fabric coupled together.

17. The protective covering of claim 1 wherein the layer of penetration resistant fabric comprises a material of 200 denier or less.

18. The protective covering of claim 1 wherein the energy absorptive layer comprises impact gels.

19. The protective covering of claim 1 wherein the resiliently compressible energy absorptive material is comprises a plurality of seamed cells.

20. The protective covering of claim 1 wherein the resiliently compressible energy absorptive material is formed into side-by-side nodes on the energy absorptive layer.

21. The protective covering of claim 1 wherein the energy absorptive layer comprises a single layer of the resiliently compressible energy absorptive material.

22. The protective covering of claim 1 wherein the resiliently compressible energy absorptive material comprises a resilience percentage of approximately 10 to 13, utilizing an ASTM D2632 test method.

23. A protective covering comprising:

an impact layer comprising a plurality of polymer plates adhered to and sandwiched between a first and a second layer of penetration resistant fabric;

an energy absorptive layer comprising a resiliently compressible energy absorptive material coupled to the impact layer, the energy absorptive layer including shear thickening silicone dilatant, the shear thickening silicone dilatant is disposed within the energy absorptive layer as one of a fluid within a plurality of baglets or instantiated as a self supporting matrix the energy absorptive layer distinct from and coupled to the impact layer; and wherein the energy absorptive layer exhibits a resiliency time from compression of less than five seconds.

* * * * *